US005803431A

United States Patent [19]

Hoang et al.

[11] Patent Number: 5,803,431

[45] Date of Patent: Sep. 8, 1998

[54] SHEARING GATE VALVE

[75] Inventors: Loc Gia Hoang, Houston, Tex.; Brian Haynes, Ackworth, England

[73] Assignee: Cooper Cameron Corporation, Houston, Tex.

[21] Appl. No.: 521,677

[22] Filed: Aug. 31, 1995

[51] Int. Cl.[6] ..... F16K 3/02

[52] U.S. Cl. ..... 251/327; 251/326

[58] Field of Search ..... 251/326, 327

[56] References Cited

U.S. PATENT DOCUMENTS

| | | | |
|---|---|---|---|
| 4,081,027 | 3/1978 | Nguyen | 166/55 |
| 4,086,832 | 5/1978 | Korytko | 83/198 |
| 4,281,819 | 8/1981 | Linder | 251/328 |
| 4,337,920 | 7/1982 | Parris | 251/357 |
| 4,341,264 | 7/1982 | Cox et al. | 166/55 |
| 4,425,699 | 1/1984 | Nordin | 29/505 |
| 4,519,575 | 5/1985 | Akkerman et al. | 251/58 |
| 4,572,298 | 2/1986 | Weston | 166/379 |
| 4,612,983 | 9/1986 | Karr, Jr. | 166/55 |
| 4,671,312 | 6/1987 | Bruton | 137/315 |
| 4,825,953 | 5/1989 | Wong et al. | 166/338 |
| 4,911,410 | 3/1990 | Baker | 251/327 |
| 4,997,162 | 3/1991 | Baker et al. | 251/327 |
| 5,370,362 | 12/1994 | Kent et al. | 251/326 |
| 5,501,424 | 3/1996 | Williams et al. | 251/326 X |

OTHER PUBLICATIONS

Cooper Industries, Cooper Oil Tool Division; *Wireline and Coil Tubing Shearing Gate and Seats*; (pp. 1–5); 04/29/92.

*Primary Examiner*—John Fox
*Attorney, Agent, or Firm*—Conley, Rose & Tayon, P.C.

[57] ABSTRACT

The shearing gate valve includes a gate reciprocably mounted between opposing seat rings. The gate has an opening which aligns with bores in the mating seat rings. The opening in the gate and the bores of the seat rings each have a cutting recess. The cutting recess in each mouth of the opening of the gate is formed by a counterbore which is filled with a weld overlay material that bonds with the material of the gate. A layer of hard facing material covers the sides of the gate and also extends over the bond formed between the gate and weld overlay material but does not completely cover the weld overlay material thus forming the cutting recess. The cutting recess has a depth equal to the thickness of the hard facing material. The weld overlay material is hard so as to prevent the formation of an upset which will score or gall the sealing surfaces between the gate and seat rings.

7 Claims, 4 Drawing Sheets

SHEARING GATE VALVE

BACKGROUND OF THE INVENTION

The invention relates to gate valves and more particularly to a valve for use on oil and gas wells which will cut a wire line or small tubular member and seal in the well under emergency conditions.

During the work over or testing of oil and gas wells, wire line operations are common. A cable passes through the well head for supporting and manipulating various tools and instruments. If an emergency arises requiring the immediate shut in of the well, there is insufficient time to withdraw the cable.

Gate valves have previously been used for shearing wire lines and small tubular members but difficulties have been encountered after shearing has occurred. Often the problem is that the valve no longer has a satisfactory seal. An additional problem is that during the shearing operation, the shearing edges are damaged and have to be repaired prior to being placed in service again.

U.S. Pat. Nos. 4,519,575 and 4,612,983 disclose typical prior art gate valves adapted for shearing a wire line extending through the valve passages and gate. U.S. Pat. No. 4,519,575 discloses a gate valve for shearing a wire line on closing and the gate valve includes a special actuator which adds closing force during the last shearing portion of the stroke. U.S. Pat. No. 4,612,983 discloses a gate valve having a pair of gates in which the lower gate closes and shears the wire line and then the upper gate closes and seals against the upper valve seat.

U.S. Pat. No. 4,281,819 discloses a balanced stem gate valve in which the sealing surfaces are hard, friction resistant sealing surfaces and suggest valve seats of metal or non-metal seat material concentrically disposed interiorally of seat retainers and sealed with sealing rings. Backup seat rings are provided and are of a hard material such as tungsten carbide.

Engineering Bulletin 689G, dated April 1992, and distributed by the Cooper Oil Tool Division of Cooper Industries, Inc., discloses a gate for a shearing type gate valve having a recessed cutting edge formed by hard facing the sealing surface of the gate. The hard facing is tungsten carbide. An annular area around the opening in the gate does not include the hard facing such that the hard facing forms an annular recessed cutting edge around the opening in the gate. For the gate material to form a cutting edge, the gate material must be very hard such as approximately 35 Rockwell C hardness. It is preferred that the material be of a nickel base material, such as Inconel 718 which is a nickel chromium alloy. Inconel 718 is very expensive and thus the gate shown in Bulletin 689G is expensive to manufacture.

U.S. Pat. No. 4,911,410 discloses a shearing type of gate valve for shearing a wire line or tubular member extending through the valve and has an insert sleeve of hard wear resistant material disposed in the opening through the gate and insert rings also of a hard, wear resistant material mounted in the seat rings. Preferably, the insert sleeve and insert rings are of tungsten carbide. The tungsten carbide insert sleeve has annular edges which serve as the cutting edges for shearing the wire line or tubular member. The insert sleeve is inserted and then shrink fitted into the opening through the gate.

U.S. Pat. No. 4,997,162 discloses a modified form of the shearing gate valve of U.S. Pat. No. 4,911,410 where an insert sleeve of hardened, wear resistant material is provided in the opening of the gate and an insert ring of hardened, wear resistant material is provided in one of the seat rings so that only a single side of the gate shears the wire line so that a short section of wire line is not created and left in the opening in the gate while it is closed.

The tungsten carbide insert sleeve of U.S. Pat. Nos. 4,991,410 and 4,997,162 is very expensive and is approximately three times as expensive as the present invention. The tungsten carbide insert sleeve is also very complex to manufacture. It must be shrink fitted into the opening of the gate to hold the insert in place. Tungsten carbide has different thermal expansion characteristics from that of the steel forming the gate. Because of the difference in thermal expansion, the tungsten carbide insert sleeve may come loose. Thus, the shrink fit must account for the affect of thermal expansion and be strong enough for the insert sleeve to stay in place during the shearing operation.

The tungsten carbide hard facing on the gate will not adhere to the surface of the tungsten carbide insert sleeve because the tungsten carbide insert sleeve is too hard to obtain a bond with the tungsten carbide hard facing. Therefore, the height of the insert sleeve above the part substrate must be installed precisely prior to the hardfacing operation.

Further, to use a tungsten carbide insert sleeve, it is necessary to enlarge the opening through the gate which reduces the thickness of the webs on each side of the opening in the gate adjacent the insert sleeve. The shrink fit causes high stress in the gate around the insert sleeve. These require that the material of the gate be of a stronger material due to the reduction of the thickness of the webs which increases the cost of the gate.

The present invention overcomes the deficiencies of the prior art.

SUMMARY OF THE INVENTION

The present invention relates to a shearing gate valve having a gate mounted between opposing seat rings. The seat rings are mounted in recesses within the valve body. The gate has an opening which aligns with bores in the mating seat rings and valve body in the open position. An actuator is connected to the gate for reciprocating the gate between open and closed positions. A counterbore is provided at each mouth of the gate opening and is filled with a weld overlay material forming an annular cutting edge at each mouth. The weld overlay material bonds with the gate. A hard facing material covers the faces of the gate and overlaps the counterbore with the weld overlay material. The hard facing material does not completely cover the weld overlay material thus forming an annular cutting recess. The cutting recess has a depth equal to the thickness of the hard facing material on the sides of the gate. Preferably, the hard facing material is tungsten carbide. The counterbore has a depth which will allow a sufficient bond between the gate and weld overlay material to withstand the forces caused during the shearing operation. Each of the seat rings also includes a cutting recess which mates with the corresponding cutting recesses in the gate.

An object of the present invention is to provide an improved shearing type of gate valve in which the valve still seals after the shearing operation.

Another object is to provide an improved shearing type of gate valve in which the gate valve may be retained in service after multiple shearing closures of the gate.

A further object is to provide an improved shearing type of gate valve in which a brittle hard material is used without having the brittle material damaged by the shearing action of the valve.

A further object of the present invention is to prevent an upset from being formed during the shearing operation and extending beyond the sealing surfaces of the gate and seat rings so as to score or gall the sealing surfaces and prevent the sealing of the valve.

Other objects and advantages of the present invention will become apparent from the following description and drawings.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENTS

Figure 1:
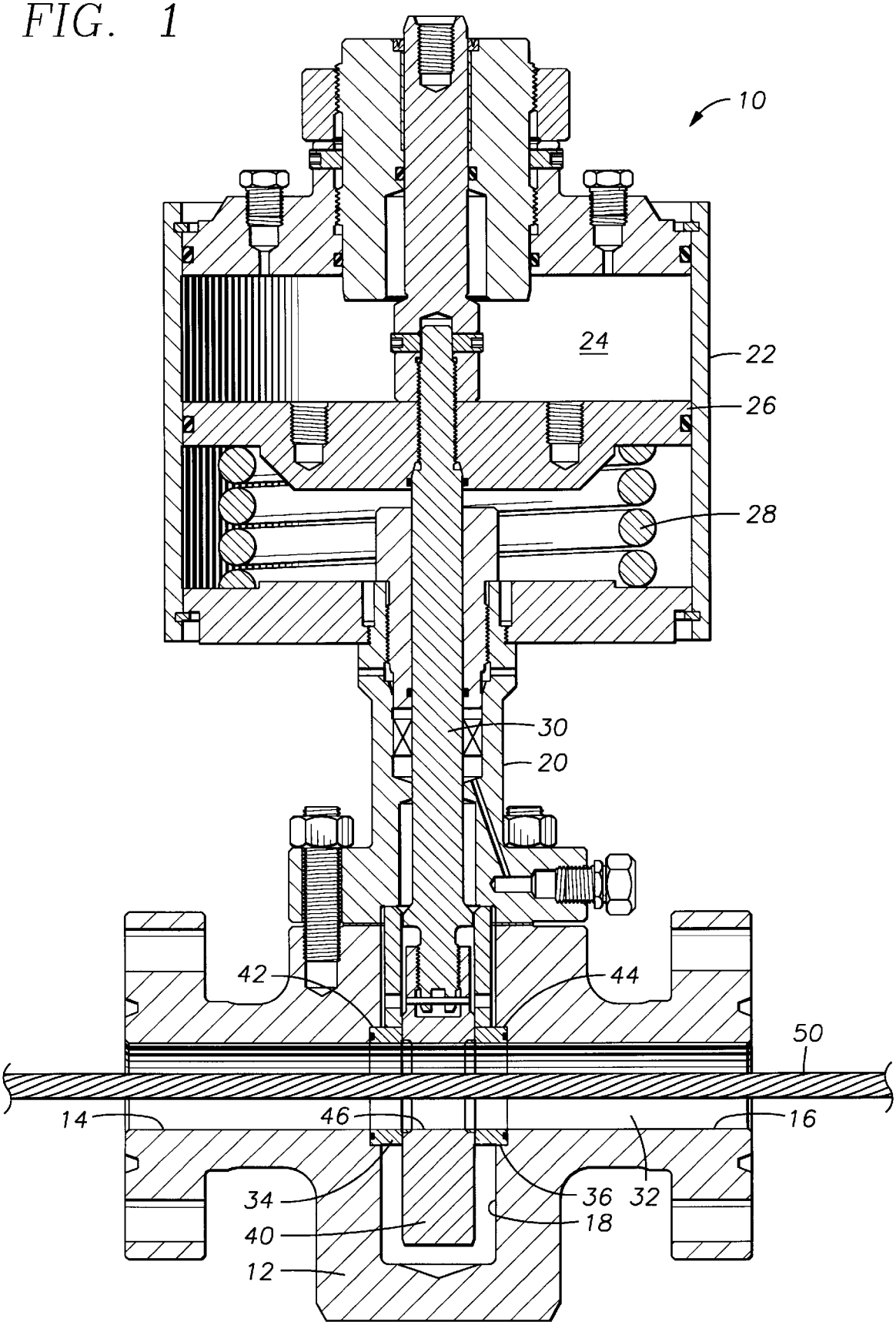
FIG. 1 is a section view of the improved shearing gate valve of the present invention shown in the open position.
Figure 2:
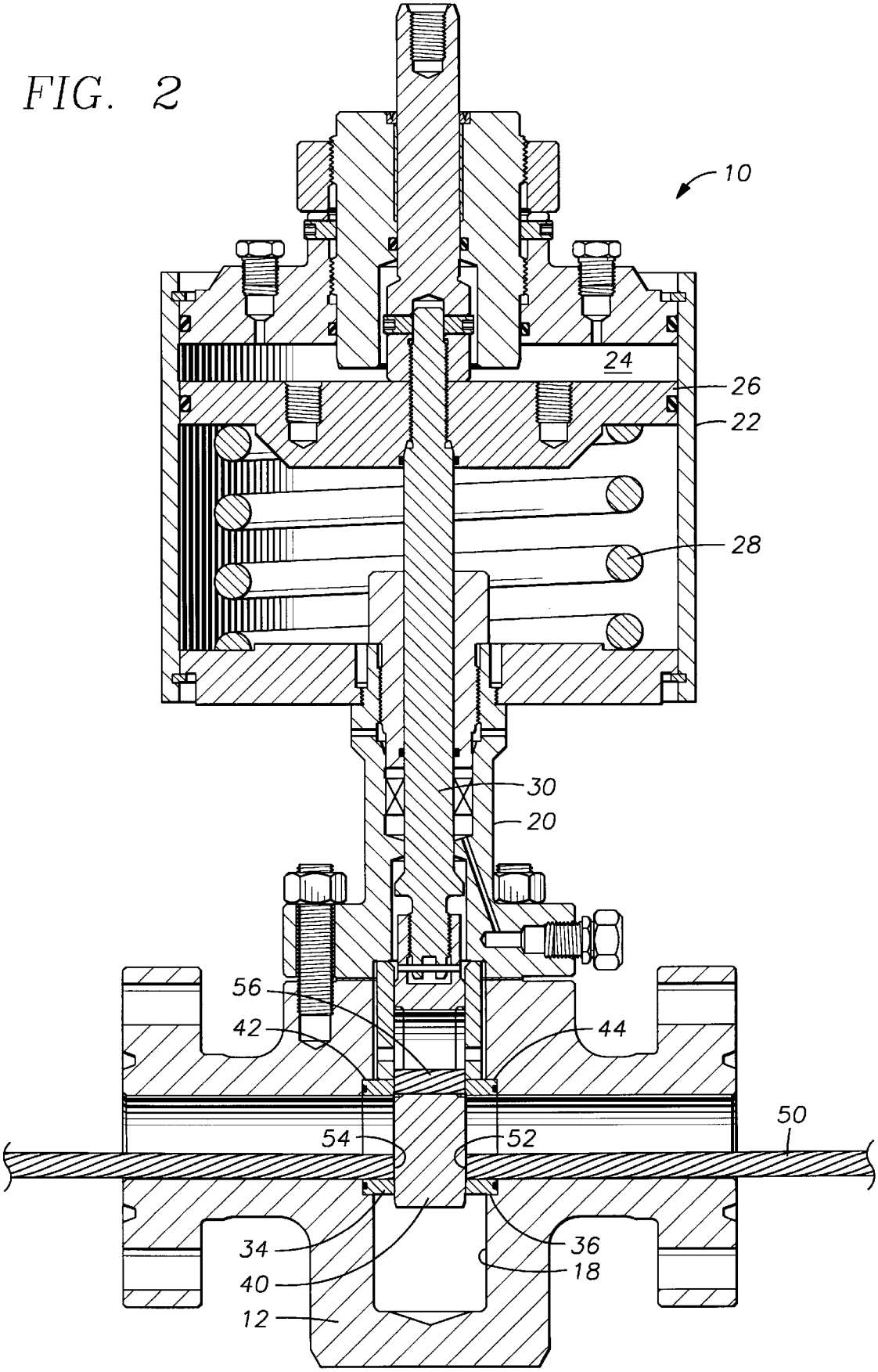
FIG. 2 is a similar section view of the valve illustrated in FIG. 1 in the closed position after shearing a wire line extending through the valve.

Referring initially to FIGS. 1 and 2, the valve 10 includes a body 12 having an inlet 14, an outlet 16 with a valve chamber 18 between the inner ends of inlet 14 and outlet 16, and a bonnet 20 which is secured to body 12 around the opening of chamber 18 into body 12. Bonnet 20 supports actuator 22 which is shown as a typical linear actuator having a piston chamber 24 with piston 26 slidable therein and a spring 28 urging piston 26 upwardly as shown. A connecting stem 30 extends from piston 26 through bonnet 20 into engagement with gate 40 for moving gate 40 within chamber 18 to open or close the flow bore 32 extending through inlet 14, chamber 18, and outlet 16. Although the valve 10 has been shown as self-actuating, the present invention may also be used with manually actuated valves.

Gate 40 is positioned in chamber 18 between seat rings 34 and 36 which are positioned in recesses 42 and 44 of body 12, respectively, which surround the inner ends of inlet 14 and outlet 16. A flow bore or opening 46, which extends through gate 40, is aligned with openings in seat rings 34, 36 during the shearing action of the gate 40 in its closing movement when there is a wire line 50 or a tubular member (not shown) extending through flow bore 32 of valve 10. The shearing of wire line 50 is shown in FIG. 2. Wire line 50 has been sheared in two places 52, 54 by the action of gate 40 on seat rings 34 and 36 leaving a sheared, short segment 56 of wire line 50.

Figure 3:
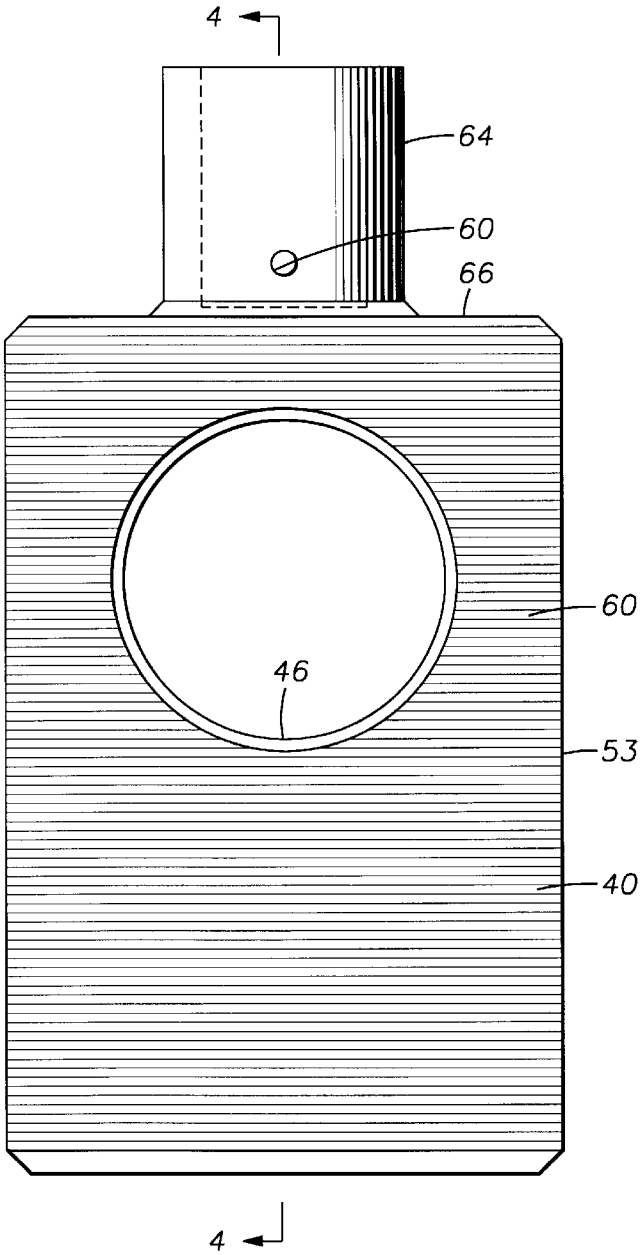
FIG. 3 is an elevation view of the improved gate of the present invention with the weld overlay material around the opening through the gate.

Referring now to FIG. 3, gate 40 is a generally flat, elongated rectangular plate 58 having an opening 46 extending through plate 58. Opening 46 forms gate webs 60, 62 on each side of the plate 58. Means 64, such as a clevis, projects upwardly from the upper terminal end 66 of plate 58 for suitable connection to connecting stem 30. Aligned apertures 68 pass through clevis 64 for attaching gate 40 to stem 30 as best shown in FIGS. 1 and 2. Gate 40 is typically made of steel, such as No. 4130 steel, and maybe made of stainless steel for certain oil and gas services.

Figure 5:
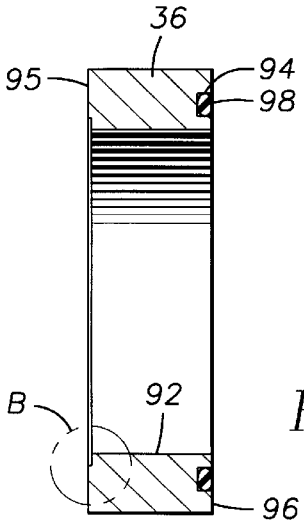
FIG. 5 is a section view of the improved seat ring illustrating the cutting recess.
Figure 5A:
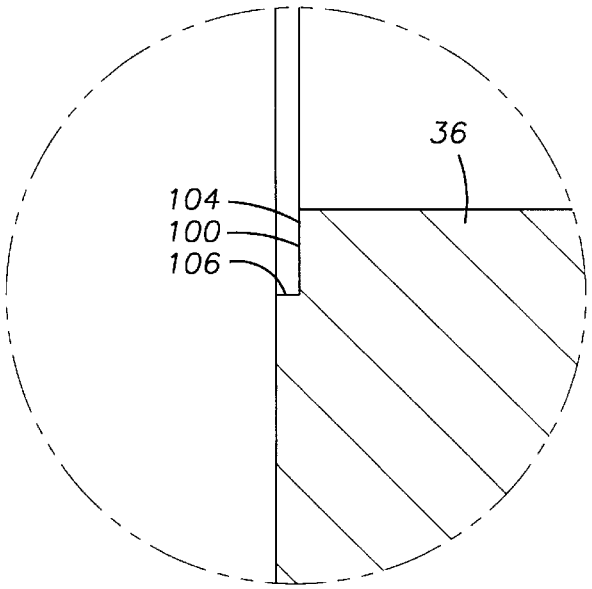
FIG. 5A is an enlarged detailed view of Detail B shown in FIG. 5.

Referring now to FIGS. 5 and 5A, seat rings 34, 36 are received within annular recesses 42, 44, respectfully, in valve body 12. Seat rings 34 and 36 are identical and, thus, reference will be made to seat ring 36 shown in FIGS. 5 and 5A to explain the details of the structure of seat rings 34, 36. Seat ring 36 is annular in shape having a bore 92 and is preferably made of a hard, wear resistant material such as Stellite 3 manufactured by Thermodyne Stellite Deloro or a steel substrate and hardfaced surface at 95. Seat ring 36 also includes an annular groove 94 on its innerface 96 for receiving a non-metallic seal 98, which sealingly engages valve body 12. Each seat ring 34, 36 is sized to fit tightly within recesses 42 and 44 of valve body 12. Each seat ring 34, 36 also includes an annular recess 100 on its outer sealing face 95 hereinafter described in detail.

Figure 4:
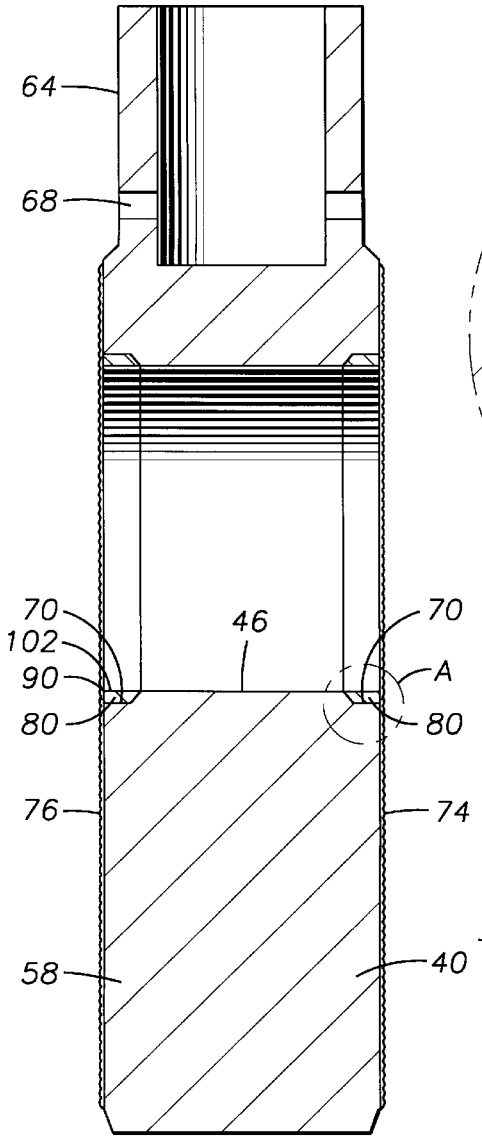
FIG. 4 is a section view taken along plane 4—4 in FIG. 3.
Figure 4A:
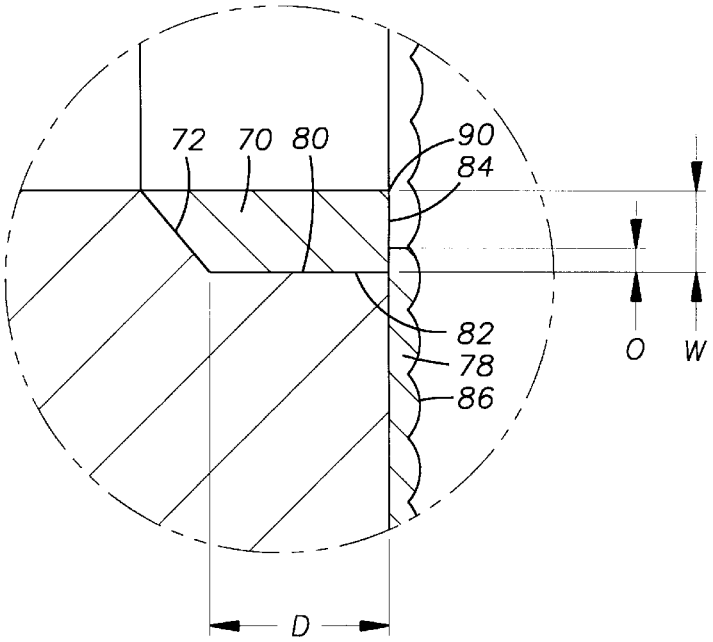
FIG. 4A is an enlarged detailed view of Detail A shown in FIG. 4.

Referring particularly now to FIGS. 4 and 4A, annular counterbores 70 are cut around each entrance or mouth of opening 46. Each counterbore 70 has a depth D, a width W, and a tapered bottom 72. The tapered bottom 72 forms a frusto-conical surface preferably having a 45° taper. The width W is preferably between 0.090 and 0.100 inches. The depth D is preferably between 0.25 and 0.50 inches. Depth D is determined by the depth required to accommodate the anticipated forces caused by the shearing operation.

Each counterbore 70 is filled with a weld overlay material 80. The tapered bottom 72 of counterbore 70 is utilized during the welding process for filling counterbore 70 with the weld overlay material 80. The hardness of the weld overlay material 80 is preferably a minimum of 35 Rockwell C and covers the entire width W counterbore 70. The weld overlay material 80 preferably includes cobalt or nickel base materials. One preferred weld overlay material 80 is Stellite 6, made by Thermodyne Stellite Deloro. The hardness of Stellite 6 is in the range of 38 to 45 Rockwell C. Various other materials for weld overlay 80 may be used, such as Stellite 12 and Colmonoy 4 and 5 manufactured by Thermodyne Stellite Deloro and Wall Colmonoy. A 90° corner is machined on weld overlay material 80 forming an annular cutting edge 90 at each mouth of opening 46. It is desirable that the weld overlay material 80 and annular cutting edge 90 be hard so that cutting edge 90 is durable enough that gate 40 may be used multiple times to shear wire line or tubular members.

Each sealing face 74, 76 on gate 40 includes a layer of hard facing material 78. The hard facing material 78 is an alloy preferably tungsten carbide combined with cobalt, nickel or chrome. Tungsten carbide hard facing 78 is placed over both sides of the gate 40 to form sealing faces 74, 76. As best shown in FIG. 4A, the layer of hard facing material 78 extends over the interface 82 formed by the bond between weld overlay material 80 and the steel material of plate 58. The hard facing material 78 overlaps interface 82 a distance O, thereby covering a small outer circumferential portion of weld overlay material 80. The distance O is preferably no more than 0.020 inches. Hard facing material 78 covers interface 82 to provide support for the bond at interface 82. During the shearing operation, as the cutting edge 90 engages the cable or tubular member to be sheared, the force placed on the weld overlay material 80 will tend to move the particles forming the bond at interface 82 such that the weld overlay material 80 may part from the steel of the plate 58 causing the bond to fracture. To prevent the bond from parting and failing at interface 82, the counterbore 70 has a minimum depth D and the hard facing material 78 has a minimum distance O overlapping weld overlay material 80.

Because the hard facing material 78 does not extend to annular cutting edge 90, an annular cutting recess 84 is formed around each mouth of opening 46. Annular cutting recess 84 includes an annular bottom surface having a width equal to the width W of weld overlay material 80, less the overlap distance O of hard facing material 78. The width of recess 84 is preferably between 0.060 and 0.090 inches measured from the cutting edge 90. The depth of recess 84 equals the thickness of the layer of hard facing material 78.

Preferably, hard facing material 78 has a thickness between 0.003 and 0.005 inches.

During the shearing operation, the annular cutting edge 90 will tend to deform thereby forming an upset. This may particularly occur at the lower center point 102 of annular cutting edge 90 where the wire line or tubular member will be supported during the shearing operation. Such an upset will score or gall the sealing faces of gate 40 and seat rings 34, 36 if the upset comes into contact with those faces.

The greater the ductility of weld overlay material 80, the greater the tendency to form an upset at cutting edge 90 during the shearing operation. To avoid the formation of an upset during the shearing operation, the material for weld overlay material 80 is hard. The weld overlay material 80 is harder than the Inconel 718. However, the weld overlay material 80 must not be so hard that it will fracture upon shearing engagement with a wire line or tubular member. Preferably, weld overlay material 80 has a range of Brinell hardness between 38 and 45 Rockwell C.

The weld overlay material 80 must be hard enough to cut during the shearing operation and yet not produce an upset which is great enough to score and gall the sealing surfaces of gate 40 and seat rings 34, 36. Any upset which may be produced should not be greater than the thickness of the hard facing material 78. Otherwise, the upset will score or gall the sealing faces of gate 40 and seat rings 34, 36. Therefore, cutting recess 84 has a predetermined depth such that any anticipated upset will not extend beyond the sealing faces 74, 76 of hard facing material 78. The dimensions of the cutting recess 84 ensure a clean cut after each shearing operation and that the upset from the shearing operation, if it occurs, will be under the sealing faces 74, 76 of valve 40.

Each annular recess 100 in seat rings 34, 36 is similar in dimensions to that of the cutting recesses 84 on gate 40. Annular recess 100 is formed by a counterbore at the mouth of each bore 92 of seat rings 34, 36 and includes a bottom 104 having a width substantially the same as width W and an annular wall 106 having a depth substantially the same as the thickness of hard facing material 78 on gate 40. The hard material of weld overlay 80 requires that recess cutting edge 100 be formed on seat rings 34, 36. The harder the weld overlay material 80, the greater the necessity for seat rings 34, 36.

Figure 6:
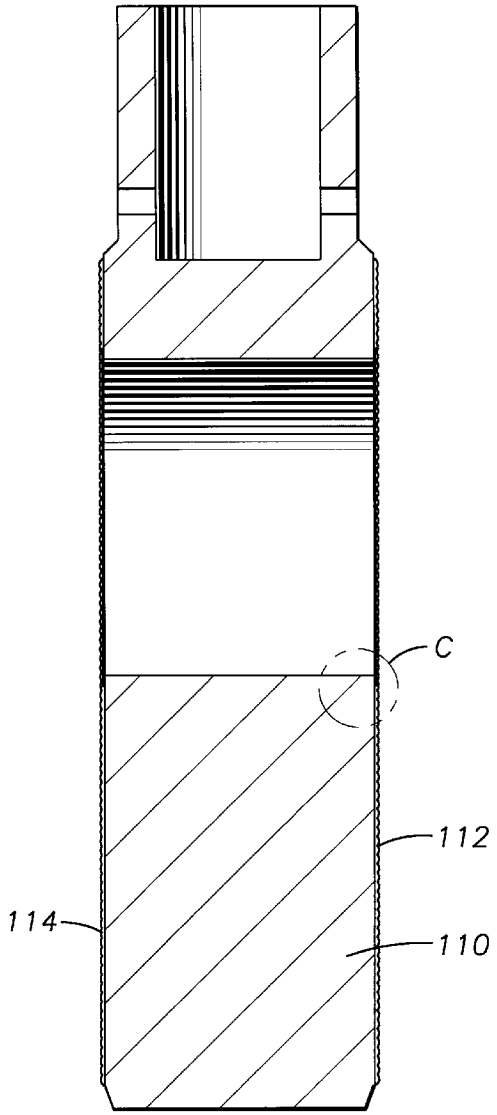
FIG. 6 is a section view of an alternative embodiment of the improved gate of the present invention.
Figure 6A:
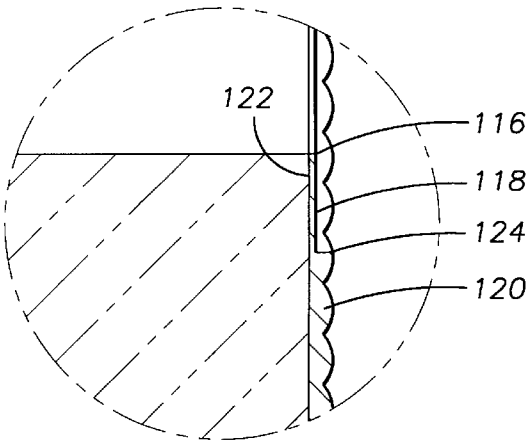
FIG. 6A is an enlarged detailed view of Detail C of FIG. 6.

Referring now to FIGS. 6 and 6A, there is shown an alternative embodiment of the improved gate of the present invention. Where features are substantially the same as those shown and described with respect to the preferred embodiment, the same numerals will be used. The gate 110 of the alternative embodiment does not include a counterbore such as shown with respect to gate 40 of the preferred embodiment. The entire sides 112, 114 of gate 110 are covered with a weld overlay material 120. A 90° corner is machined in the weld overlay material to form an annular cutting edge 116. An annular recess 118 is also machined in the weld overlay material 120 to form an annular bottom surface 122 and an annular side wall 124. Seat rings 34, 36 with annular recess 100 may be used with both embodiments. This alternative embodiment avoids the necessity of a counterbore at each mouth of opening 46 and any potential problems with the bonding at the interface between the overlay weld material and the material of the gate.

The shearing gate valve of the present invention is used on a well and has a wire line 50 or small tubular member extending therethrough. The gate valve is positioned to have its left side, as shown in the drawings, facing in the downward direction. The wire line 50 which is sheared by the gate 40 is dropped into the well.

From the above, it can be seen that the improved shearing gate valve of the present invention provides a gate valve which can shear a wire line or other tubular member extending therethrough without damage to the gate and seat rings or without interfering with the sealing of the gate and the seal rings. This allows the valve 10 to be used without repair or replacement through several cycles of closing and shearing whereas shearing gate valves of the prior art can only be expected to accomplish a single shearing and even following such single shearing may have been damaged sufficiently to provide an imperfect seal.

It should be appreciated that although the weld overlay material 80 is shown to merely fill counterbore 70, that the diameter of opening 46 may be enlarged such that the entire inner diameter of opening 46 may be filled with weld overlay material 80. Covering the entire inner circumference of opening 46 with weld overlay material 80 would, however, substantially increase the cost of the gate 40. Further, it should be appreciated that the weld overlay material 80 and hard facing material 78 may be of the same material.

While a preferred embodiment of the invention has been shown and described, modifications thereof can be made by one skilled in the art without departing from the spirit of the invention.

We claim:

1. A gate for a shearing gate valve comprising:

an elongated body having flat sides and an aperture therethrough and a counterbore at a mouth of said aperture;

a hard material filling said counterbore and forming an annular cutting edge at said mouth;

said hard material bonding with said body; and hard facing material on said flat sides covering said bond.

2. A gate for a shearing gate valve comprising:

an elongated body having flat sides and an aperture therethrough and a counterbore at a mouth of said aperture;

a hard material filling said counterbore and forming an annular cutting edge at said mouth;

said hard material bonding with said body;

hard facing material on said flat sides covering said bond; and said hard facing material not completely covering said hard material and forming an annular cutting recess.

3. The gate of claim 2 wherein said cutting recess has a depth equal to the thickness of said hard facing material.

4. The gate of claim 3 wherein said hard facing material is an alloy of tungsten carbide.

5. The gate of claim 1 wherein said counterbore has a depth which will allow a sufficient bond between said body and weld overlay material to withstand the loading forces caused during the shearing operation.

6. The gate of claim 1 wherein said weld overlay material has a Rockwell C hardness in the range of 38 to 45.

7. The gate of claim 1 wherein the depth of said counterbore is 0.25 to 0.50 inches and the width is 0.090 to 0.100 inches.

* * * * *